United States Patent [19]

Baysinger et al.

[11] 3,980,420

[45] Sept. 14, 1976

[54] BURNER CONTROL SYSTEM FOR DOMESTIC GAS RANGE OVENS

[75] Inventors: Robert L. Baysinger; John J. Love, both of St. Louis, Mo.

[73] Assignee: Emerson Electric Co., St. Louis, Mo.

[22] Filed: July 3, 1975

[21] Appl. No.: 592,976

[52] U.S. Cl. ..... 431/78; 236/15 A; 431/66

[51] Int. Cl.[2] ..... F23N 5/00

[58] Field of Search ..... 431/66, 67, 68, 74, 431/77, 78; 236/15 A; 126/273

[56] References Cited

UNITED STATES PATENTS

| | | | |
|---|---|---|---|
| 3,584,988 | 6/1971 | Hirsbrunner et al. | 431/66 |
| 3,600,117 | 8/1971 | Hirsbrunner | 431/66 |
| 3,732,433 | 5/1973 | Lourigam | 431/74 X |
| 3,862,820 | 1/1975 | Hantack | 431/66 |
| 3,871,814 | 3/1975 | Das et al. | 431/66 |

*Primary Examiner*—Edward G. Favors

[57] ABSTRACT

Fuel flow to a gas oven burner is controlled by a manual rotary valve and a series flow arranged, electrically operated valve and is ignited by a ceramic glow igniter. The electrically operated valve and glow coil are series connected across a power source through a manual line switch and an adjustable temperature responsive switching means. A control knob, when rotated, rotates the manual rotary valve, actuates the line switch, and adjusts the temperature responsive switching means.

6 Claims, 5 Drawing Figures

BURNER CONTROL SYSTEM FOR DOMESTIC GAS RANGE OVENS

This invention relates generally to control systems for fluid fuel burners, and particularly to electrically operated ignition and fuel flow control means for domestic gas range oven burners.

The primary object of the invention is to provide a generally new, safe, and reliable electrical ignition and fuel flow control system for domestic gas range oven burners which is of particularly simple and economical construction.

A further object is to provide an electrical ignition and fuel control system for gas oven burners in which an electrically operated gas valve and a ceramic glow igniter having a negative coefficient of electrical resistance are series connected across a power source, and in which the electrically operated valve is energized sufficiently to open only when sufficient current has passed through the series connected glow igniter to heat it to gas ignition temperature.

A further object is to provide an electrically operated ignition and fuel flow control system for gas burners in which a gas valve is actuated by a heat motor having an electrical resistance heater, in which a ceramic glow igniter is connected in series with the resistance heater through signal controlled, bi-directional, solid state switching means, and in which means responsive to temperature change in a space being heated by the burner controls conduction of the switching means.

A further object is to provide an oven temperature responsive means for controlling the operation of a ceramic glow igniter and an electrically operated fuel valve series connected across an a.c. power source through a signal controlled, bi-directional, solid state switch, which comprises a temperature variable resistor responsive to oven temperature change and means responsive to a change in the resistance thereof, resulting from a drop in oven temperature, to apply a gating signal to the bi-directional switch each half cycle of the a.c. power source.

Further objects and advantages will appear from the following description when read in connection with the accompanying drawing.

In the drawing:

FIG. 5 is a top plan view taken along line 5—5 of

DESCRIPTION OF THE VALVE DEVICE

Figure 1:
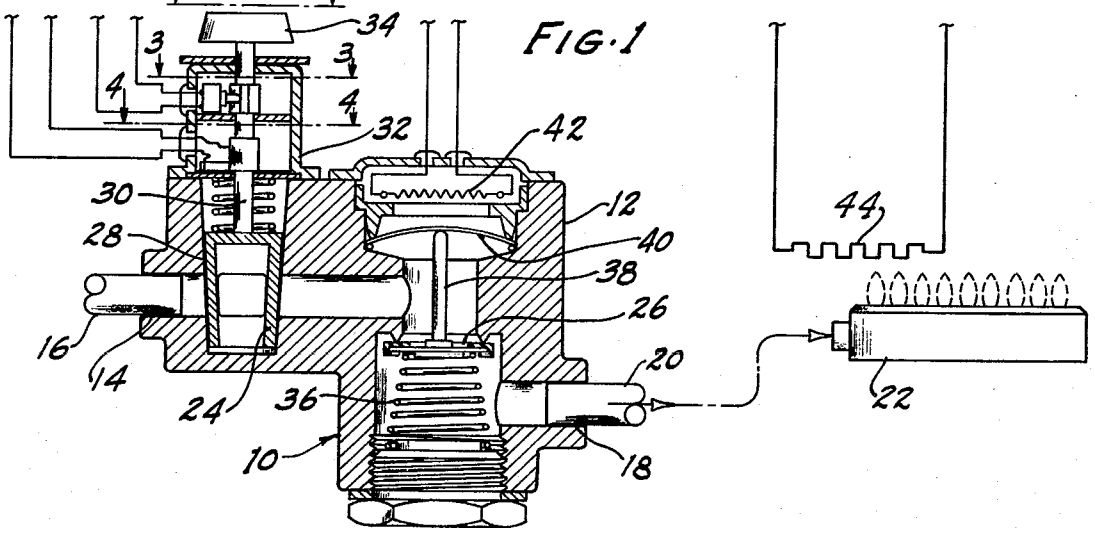
FIG. 1 is a cross-sectional view of a gas valve device employed in the system, constructed in accordance with the present invention and shown in association with a gas burner and glow igniter.

Referring to FIG. 1, a manifold gas valve device, generally indicated at 10, has a body member 12. Body 12 has an inlet 14 receiving a gas supply conduit 16 and an outlet 18 receiving a conduit 20 leading to a burner 22. Passageway means in body 12 connects inlet 14 with outlet 18, and gas flow therethrough is controlled by a manually operated, hollow, rotary plug valve 24 and a series flow arranged, heat motor operated valve 26.

The tapered plug valve 24 is fitted in a tapered bore 28 in body 12 and includes a stem 30 extending upwardly through a cylindrical casing 32 mounted on the upper surface of body 12. A control knob 34 is attached to the upper end of stem 30 for manually rotating valve 24. The valve 26 is biased closed by a spring 36, and it has an upwardly extending valve stem 38 engaging the center of a bimetal snap disc 40.

Bimetal snap disc 40 is shown in a cold position. When sufficiently heated, the disc snaps through a planar form to a downwardly convex form and opens valve 26 with a snap action. An electrical resistance heater 42 supported in heat transfer relationship with bimetal disc 40 is operative when sufficient electrical current has passed therethrough for a sufficient period of time to heat disc 40 and effect opening of valve 26. When resistance heater 42 is de-energized, the bimetal disc 40 cools and returns to the position shown, and valve 26 closes with a snap action under the bias of spring 36. Resistance heater 42 may be constructed of any suitable material such as nickel-chromium alloy.

Figure 3:
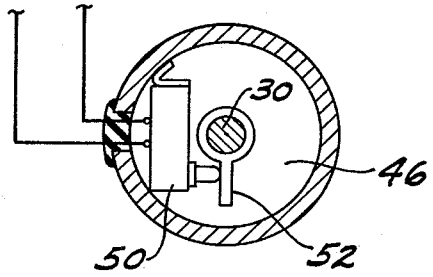
FIG. 3 is a cross-sectional view taken along line 3—3 of FIG. 1.
Figure 4:
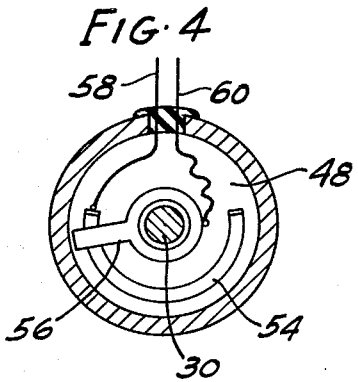
FIG. 4 is a cross-sectional view taken along line 4—4 of FIG. 1.
Figure 5:
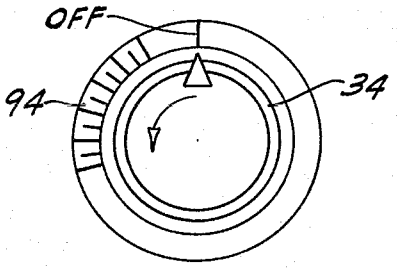

The cylindrical casing 32 on body 12 is divided into upper and lower chambers 46 and 48, respectively, see FIGS. 3 and 4. Mounted in upper chamber 46, see FIG. 3, is a normally closed microswitch 50. Switch 50 is held in open position by an arm 52, attached to rotary valve stem 30, when rotary valve 24 and control knob 34 are, respectively, in the closed and off positions indicated in the drawing.

Referring to FIG. 4, a manually variable resistance element 54 is arranged arcuately and swept by a contact arm 56 attached to and insulated from valve stem 30. The contact arm 56 is shown in the position it assumes when rotary valve 24 is closed and control knob 34 is in an off position. As control knob 34 is rotated counterclockwise from the off position to open plug valve 24, the microswitch 50 is permitted to close. Also, this counterclockwise rotation of control knob 34 progressively increases the resistance between leads 58 and 60 which are connected to one end of resistance element 54 and contact arm 56, respectively.

A silicon-carbide glow coil 44 arranged to be heated to gas ignition temperature by the passage of electrical current therethrough is shown positioned so as to ignite burner 22. The silicon-carbide glow coil 44 is a commercially available device having a negative coefficient of resistance and relatively high resistivity at normal ambient temperatures, and requires the application of a predetermined voltage thereacross for a predetermined time to heat it to gas ignition temperature.

DESCRIPTION OF THE CONTROL CIRCUITS

Figure 2:
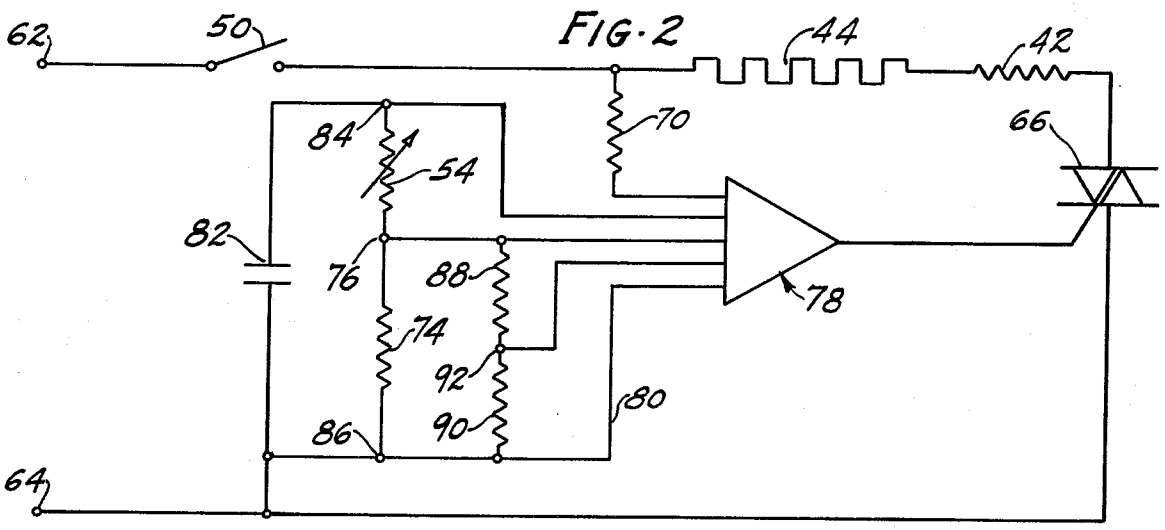
FIG. 2 is a diagram of the electrical control circuits.

Referring to FIG. 2, the resistance heater 42 and the silicon-carbide glow igniter 44 are shown series connected across terminals 62 and 64 of an a.c. power supply through the microswitch 50 and a triac 66. The resistance of silicon-carbide glow coil 44 is relatively high in cold condition, but decreases initially at a relatively high rate as it is heated by passage of current therethrough. As the temperature of the coil approaches gas ignition temperature, this rate of decrease in resistance levels off to zero, thereby precluding runaway current flow. The relatively constant resistance of the series connected resistance heater 42 is low enough to permit the glow coil 44 to attain temperatures above gas ignition temperature. When the current flow through glow coil 44 is sufficient to heat the coil to ignition temperature, the heat output of the series connected resistance heater 42 becomes sufficient to heat bimetal disc 40 and effect its snap over to open valve 26.

A zero switching device generally indicated at 78 is operative to apply a gating pulse to triac 66 each half cycle of the power supply in response to the occurrence of a signal voltage at a point 76 between the series connected, manually adjustable resistor 54 and a thermistor 74. The thermistor 74 having a negative coefficient of resistance is positioned in an oven heated by burner 22, so that its resistance varies inversely with the oven temperature variations.

The zero switching device 78 is an RCA-CA3058 integrated circuit, zero voltage switching device, or its equivalent, and is operative in response to the application of a signal voltage occurring at point 76 to apply a gating pulse to triac 66 at the beginning of each half cycle of the a.c. power supply very close to the zero crossover.

Switching device 78 is connected across the power source terminals in parallel with triac 66, resistance heater 42, and glow coil 44 through a voltage dropping resistor 70 and a lead 80. Rectifying means incorporated within device 78, together with an external storage capacitor 82 connected in parallel with resistors 54 and 74, maintains a positive voltage at a point 84 with respect to a point 86.

One side of a differential amplifier incorporated in device 78 is connected to point 76. When the voltage at point 76 becomes positive with respect to a constant reference voltage applied to the other side of the differential amplifier, gating pulses are applied to triac 66, and when the voltage at point 76 is equal to or negative with respect to this reference voltage, the triac 66 is not gated. Therefore, as the oven temperature to which thermistor 74 responds decreases, the resistance of thermistor 74 increases and the voltage at point 76 correspondingly increases, and when this voltage becomes positive with respect to the reference voltage applied to the differential amplifier of device 78 the triac is gated. The oven temperature and corresponding resistance value of thermistor 74 at which the voltage at point 76 attains such value as to affect the gating and conduction of triac 66 may be varied by the manual adjustment of resistor 54.

The slow rate of temperature change, particularly in cooling, which may occur in well-insulated cooking ovens may result in a dwell at or very near the critical control point voltage at 76 with a resulting skip gating of triac 66 or at least undesirable short cycling of the glow coil and fuel valve. In order to minimize such undersirable operation, a feedback voltage is applied to the constant reference voltage side of the differential amplifier of device 78, thereby to prolong its instant mode at the control point voltage until some significant variation from the control point voltage occurs as a result of oven temperature change. This feedback is accomplished by the provision of series connected, voltage dividing resistors 88 and 90 connected in parallel with thermistor 74 and by connecting a point 92 between these resistors with the constant reference voltage side of the differential amplifier.

OPERATION OF THE SYSTEM

The system is shown in an inoperative condition, with control knob 34 in an off position, with line switch 50 open, and with the manual rotary valve 24 and heat motor-operated valve 26 in closed position. Under these conditions, if the burner 22 has not been operated for a period of time, the thermistor 74, positioned in an oven, will be in a cold, high resistance condition.

When it is desired to heat the oven and maintain a preselected oven temperature, the knob 34 is turned counterclockwise to a selected oven temperature, as indicated on an indicia plate 94. The initial counterclockwise movement of knob 34 permits line switch 50 to close and causes the hollow rotary plug valve 24 to be opened. The wall of plug valve 24 is ported so that it is opened sufficiently to permit adequate gas flow to the burner for proper ignition when knob 34 is rotated counterclockwise from the off position an amount sufficient to permit closure of switch 50.

The closure of switch 50 connects the series connected triac 66, resistance heater 42, and glow igniter 44 across the a.c. power source terminals 62 and 64, and the zero voltage device 78 and external circuitry across the power source in parallel therewith. A positive voltage greater than the signal control point voltage will now appear at point 76 under cold oven conditions and gating of the triac 66 occurs. When the resistance of ceramic glow igniter 44 has dropped sufficiently due to its being heated to ignition temperature, sufficient current will now flow through series connected resistance heater 42 to effect a heat output thereof sufficient to cause bimetal disc 40 to snap over and open valve 26.

Gas now flows to burner 22 and is ignited by glow coil 44. As the temperature of the oven heated by burner 22 increases, the resistance of thermistor 74 decreases and the voltage at point 76 decreases. When the voltage at point 76 decreases to or below the signal control point voltage, gating and conduction of triac 66 will be cut off. Bimetal disc 40 now cools and snaps over to its cold position, permitting valve 26 to close and thereby extinguish the burner.

The oven and thermistor 74 will now slowly cool, and when the resistance of thermistor 74 increases sufficiently, a signal voltage will again appear at point 76 and effect the gating of triac 66 and the heating of glow coil 44 and resistance heater 42 and the opening of valve 26. When it is desired to discontinue operation of burner 22, the control knob 34 is rotated clockwise to the off position. This action positively cuts off fuel flow to the burner and opens line switch 50 to disconnect the system from the power source.

We claim:

1. In a control system for an oven gas burner,
a source of electrical power,
a heat motor operated gas valve including an electrical resistance heater operative to effect opening of said valve when sufficient current is passing therethrough,
a silicon-carbide glow coil for igniting said burner,
a thyristor,
circuit means connecting said resistance heater, said glow coil, and said thyristor in series across said power source,
and means responsive to oven temperature variations controlling conduction of said thyristor.

2. The control system claimed in claim 1 in which said heat motor-operated gas valve further includes a bimetal snap disc arranged to be heated by said resistance heater and operative to impart a snap-action movement of said valve.

3. In a control system for gas oven burners,
an electrical power source,
a burner, a normally closed gas valve, a heat motor including an electrical resistance heater operative when energized to effect opening of said gas valve, a ceramic glow igniter having a negative coefficient of resistance for igniting said burner, a thyristor, circuit means connecting said resistance heater, said glow igniter, and said thyristor in series across said power source, and gating means for said thyristor including a temperature variable resistor responsive to oven temperature variations and operative to control the gating of said thyristor.

4. The control system claimed in claim 3 in which the current flow through said resistance heater required to produce a sufficient heat output to effect opening of said valve is greater than the current flow through said glow igniter at ignition temperature.

5. In a control system for gas oven burners, a source of a.c. electrical power, a burner, a normally closed gas valve, a heat motor including an electrical resistance heater operative when energized sufficiently to effect opening of said gas valve, a silicon-carbide glow coil for igniting said burner, a triac, circuit means connecting said resistance heater, said glow coil, and said triac in series across said power source, a zero voltage switching device connected across said power source and operative in response to the application of a signal voltage to apply a gating pulse to said triac each half cycle of the power supply near the zero voltage point, a temperature variable resistor responsive to oven temperature variations, and circuit means including said temperature variable resistor connected across said power source and operative to apply a signal voltage to said zero voltage switch when said oven temperature drops below a predetermined point.

6. The control system claimed in claim 5 in which said circuit means operative to apply a signal voltage to said zero voltage switch further includes a manually adjustable resistance element connected in series with said temperature variable resistor and operative to vary the oven temperature point below which a signal voltage is applied to said zero voltage switch.

* * * * *